US007592113B2

(12) United States Patent
Nagasaka et al.

(10) Patent No.: US 7,592,113 B2
(45) Date of Patent: Sep. 22, 2009

(54) ELECTROPHOTOGRAPHIC PHOTOSENSITIVE MEMBER, PROCESS CARTRIDGE, AND ELECTROPHOTOGRAPHIC APPARATUS

(75) Inventors: Hideaki Nagasaka, Sunto-gun (JP); Kunihiko Sekido, Numazu (JP); Michiyo Sekiya, Mishima (JP); Nobumichi Miki, Sunto-gun (JP); Yosuke Morikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/130,398

(22) Filed: May 30, 2008

(65) Prior Publication Data

US 2008/0233499 A1 Sep. 25, 2008

Related U.S. Application Data

(62) Division of application No. 11/159,307, filed on Jun. 23, 2005, now Pat. No. 7,396,622.

(51) Int. Cl.
*G03G 5/047* (2006.01)

(52) U.S. Cl. ..... 430/59.4; 430/59.1; 399/159

(58) Field of Classification Search ..... 430/59.4, 430/59.1; 399/159
See application file for complete search history.

(56) References Cited

U.S. PATENT DOCUMENTS

| | | | | |
|---|---|---|---|---|
| 5,370,953 | A | 12/1994 | Nakatani | 430/58 |
| 5,677,095 | A * | 10/1997 | Kikuchi et al. | 430/58.15 |
| 5,875,375 | A | 2/1999 | Ohmori et al. | 399/159 |
| 6,391,505 | B1 | 5/2002 | Hamasaki et al. | 430/59.4 |
| 6,400,916 | B1 | 6/2002 | Go et al. | 399/111 |
| 6,541,172 | B2 | 4/2003 | Nagasaka et al. | 430/59.5 |
| 6,586,148 | B1 | 7/2003 | Graham et al. | 430/58.65 |
| 6,697,591 | B2 | 2/2004 | Morikawa et al. | 399/159 |
| 6,829,459 | B2 | 12/2004 | Tanaka et al. | 399/176 |
| 2004/0043315 | A1 | 3/2004 | Takiguchi et al. | 430/108.6 |
| 2005/0238974 | A1 | 10/2005 | Sekiya et al. | 166/264 |

FOREIGN PATENT DOCUMENTS

| | | |
|---|---|---|
| JP | 59-224846 | 12/1984 |
| JP | H02-136860 | 5/1990 |
| JP | H02-136861 | 5/1990 |
| JP | H02-146048 | 6/1990 |
| JP | H02-146049 | 6/1990 |
| JP | H02-146050 | 6/1990 |
| JP | 4-338761 | 11/1992 |
| JP | H05-150498 | 6/1993 |
| JP | H06-313974 | 11/1994 |
| JP | H07-104495 | 4/1995 |
| JP | H11-172142 | 6/1999 |
| JP | 2000-039730 | 2/2000 |
| JP | 2000-292946 | 10/2000 |
| JP | 2001-040237 | 2/2001 |
| JP | 2002-091039 | 3/2002 |
| JP | 2002-296817 | 10/2002 |

OTHER PUBLICATIONS

Diamond, Arthur S. & David Weiss (eds.) Handbook of Imaging Materials, 2nd ed., New York: Marcel-Dekker, Inc. (Nov. 2001) pp. 145-164.

Borsenberger, Paul M. et al., Organic Photoreceptors for Imaging Systems, New York: Marcel-Dekker, Inc., pp. 181, 182, 289-292 (1993).

English translation of JP 59-224846 (Dec. 1984).

* cited by examiner

*Primary Examiner*—Christopher RoDee
(74) *Attorney, Agent, or Firm*—Fitzpatrick, Cella, Harper & Scinto

(57) ABSTRACT

An electrophotographic photosensitive member includes a support, a charge generation layer containing a charge generating material, and a binder resin, on the support, and a hole transport layer containing a hole transporting material, on the charge generation layer. The charge generation layer contains an acenaphthene compound represented by the following formula:

(4)

$Z^{401}$ and $Z^{402}$ each independently represent an oxygen atom, a $=C(CN)_2$ group or a $=N$ Ph group; and $R^{401}$ and $R^{402}$ each independently represented a hydrogen atom, a halogen atom, a nitro group, a substituted or unsubstituted alkyl group or a substituted or unsubstituted alkoxy group. The acenaphthene compound has the structure represented by the above formula (4) is contained in the charge generation layer in an amount of from 51% by weight to 80% by weight based on the weight of the binder resin in the charge generation layer.

5 Claims, 2 Drawing Sheets

ELECTROPHOTOGRAPHIC PHOTOSENSITIVE MEMBER, PROCESS CARTRIDGE, AND ELECTROPHOTOGRAPHIC APPARATUS

This is a divisional of U.S. patent application Ser. No. 11/159,307, filed Jun. 23, 2005, now U.S. Pat. No. 7,396,622, issued Jul. 8, 2008.

BACKGROUND OF THE INVENTION

1. Field of the Invention

This invention relates to an electrophotographic photosensitive member, and a process cartridge and an electrophotographic apparatus which have the electrophotographic photosensitive member.

2. Related Background Art

In recent years, in electrophotographic apparatus such as copying machines and printers, widely used is an electrophotographic photosensitive member (an organic electrophotographic photosensitive member) having a photosensitive layer containing an organic charge-generating material and a charge-transporting material. As such a photosensitive layer, from the viewpoint of durability, what is prevalent is one having layer configuration of a multi-layer type (regular-layer type) in which a charge generation layer containing a charge-generating material and a charge transport layer (a hole transport layer) containing a charge-transporting material are superposed in this order from the support side.

Of charge-generating materials, a charge-generating material having sensitivity in the red or infrared region is used in electrophotographic photosensitive members mounted to laser beam printers or the like having markedly advanced in recent years, and the demand therefor has increased with more frequency. As charge-generating materials having a high sensitivity in the red or infrared region, phthalocyanine pigments such as oxytitanium phthalocyanine, hydroxygallium phthalocyanine and chlorogallium phthalocyanine and azo pigments such as monoazo, bisazo and trisazo pigments are known in the art.

There, however, has been a problem that, where such highly sensitive charge-generating materials are used, electric charges are generated in so large a quantity that electrons existing after holes have been injected into the hole transport layer tend to stagnate in the charge generation layer to tend to cause memory. Stated specifically, what is called a positive ghost, in which the image density comes high only at areas exposed to light at previous rotation, and what is called a negative ghost, in which the image density comes low only at areas exposed to light at previous rotation, are seen in images reproduced.

As background art which can keep such a ghost phenomenon from occurring, Japanese Patent Applications Laid-open No. H11-172142 and No. 2002-091039 disclose techniques in which II-type chlorogallium phthalocyanine is used as the charge-generating material. Japanese Patent Application Laid-open No. H07-104495 discloses a technique in which a charge generation layer making use of oxytitanium phthalocyanine is incorporated with an acceptor compound. Japanese Patent Applications Laid-open No. 2000-292946 and No. 2002-296817 disclose techniques in which a charge generation layer making use of a phthalocyanine is incorporated with a dithiobenzyl compound. Besides, Japanese Patent Applications Laid-open No. H02-136860, No. H02-136861, No. H02-146048, No. H02-146049, No. H02-146050, No. H05-150498, No. H06-313974, No. 2000-039730, No. 2000-292946 and No. 2002-296817 disclose techniques in which the charge generation layer is incorporated with an electron-transporting material, an electron-accepting material or an electron-attracting material.

Incidentally, Japanese Patent Application Laid-open No. 2001-040237 discloses a technique in which, for the purpose of making sensitivity higher, an organic acceptor compound is added in the step of pigmentation to produce phthalocyanine crystals.

Electrophotographic techniques have made remarkable progress in these days, and electrophotographic photosensitive members are also required to have much superior performance.

For example, black and white images such as characters or letters have been main in the past. In recent years, however, there is an increasing demand for color images of photographs or the like, and the requirement for their image quality is becoming higher year after year.

The above ghost phenomenon tends to appear especially in halftone images, and especially come into important question in color images, which are often formed by superimposing halftone images.

In addition, in the case of color images, even though the level of a ghost for each color is equal to that of black and white images, the ghost phenomenon tends to appear conspicuously because a plurality of colors are superimposed.

As a method for keeping the ghost phenomenon from occurring, a method is available in which the electrophotographic apparatus is provided with a destaticizing means such as pre-exposure. However, from the viewpoint of making the electrophotographic apparatus main body low-cost and small-size, it has become frequent to provide no destaticizing means.

The above background art has not been sayable to be well effective for such circumstances that are severe on the ghost phenomenon.

SUMMARY OF THE INVENTION

An object of the present invention is to provide an electrophotographic photosensitive member that is excellently effective in keeping ghosts from occurring, and can not easily cause the ghost phenomenon even when mounted to color electrophotographic apparatus or electrophotographic apparatus having no destaticizing means, and provide a process cartridge and an electrophotographic apparatus which have such an electrophotographic photosensitive member.

That is, the present invention is an electrophotographic photosensitive member comprising a support, a charge generation layer containing a charge-generating material and a binder resin, provided on the support, and a hole transport layer containing a hole-transporting material, provided on the charge generation layer, wherein;

the charge generation layer contains a phenanthrene compound having a structure represented by the following formula (2), a phenanthroline compound having a structure represented by the following formula (3) or an acenaphthene compound having a structure represented by the following formula (4).

(2)

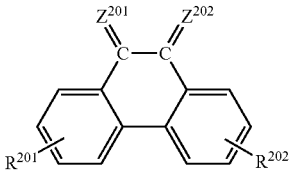

In the formula (2), $Z^{201}$ and $Z^{202}$ each independently represent an oxygen atom, a $=C(CN)_2$ group or a $=N$-Ph group; and $R^{201}$ and $R^{202}$ each independently represent a hydrogen atom, a halogen atom, a nitro group, a substituted or unsubstituted alkyl group or a substituted or unsubstituted alkoxy group.

(3)

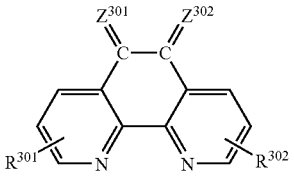

In the formula (3), $Z^{301}$ and $Z^{302}$ each independently represent an oxygen atom, a $=C(CN)_2$ group or a $=N$-Ph group; and $R^{301}$ and $R^{302}$ each independently represent a hydrogen atom, a halogen atom, a nitro group, a substituted or unsubstituted alkyl group or a substituted or unsubstituted alkoxy group.

(4)

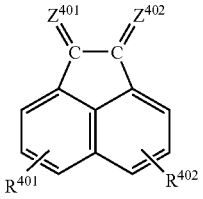

In the formula (4), $Z^{401}$ and $Z^{402}$ each independently represent an oxygen atom, a $=C(CN)_2$ group or a $=N$-Ph group; and $R^{401}$ and $R^{402}$ each independently represent a hydrogen atom, a halogen atom, a nitro group, a substituted or unsubstituted alkyl group or a substituted or unsubstituted alkoxy group.

The present invention also provides a process cartridge and an electrophotographic apparatus which have the above electrophotographic photosensitive member.

DESCRIPTION OF THE PREFERRED EMBODIMENTS

Figure 1:
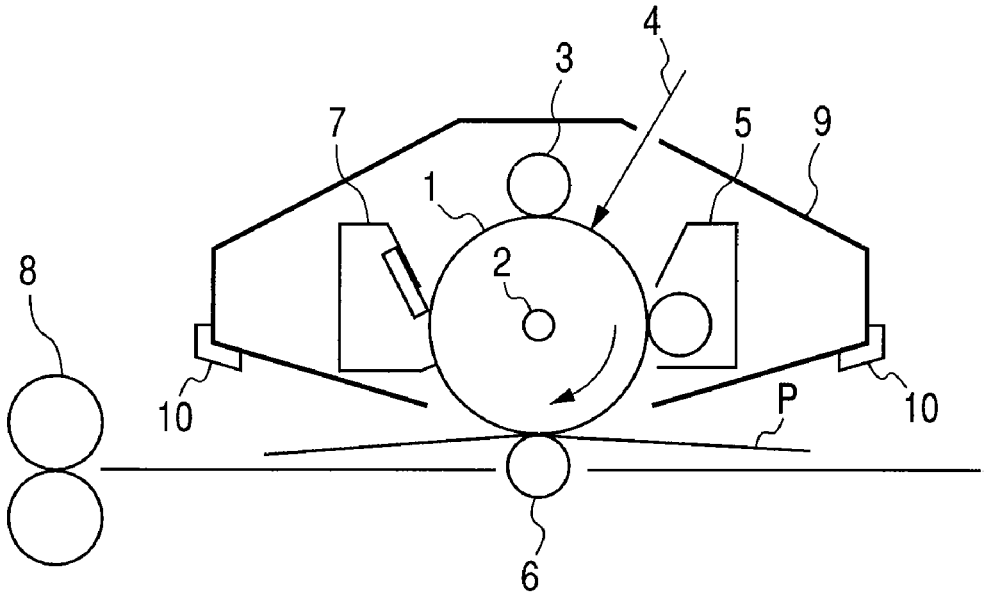
FIG. 1 is a schematic view showing an example of the construction of an electrophotographic apparatus provided with a process cartridge having the electrophotographic photosensitive member of the present invention.

The present invention is described below in detail.

The electrophotographic photosensitive member of the present invention has a support, a charge generation layer containing a charge-generating material and a binder resin, provided on the support, and a hole transport layer containing a hole-transporting material, provided on the charge generation layer.

The charge generation layer of the electrophotographic photosensitive member of the present invention contains, in addition to the charge-generating material and the binder resin, a phenanthrene compound having a structure represented by the following formula (2), a phenanthroline compound having a structure represented by the following formula (3) or an acenaphthene compound having a structure represented by the following formula (4).

(2)

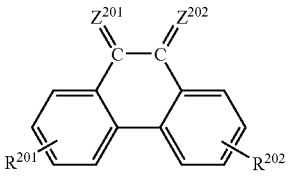

In the formula (2), $Z^{201}$ and $Z^{202}$ each independently represent an oxygen atom, a $=C(CN)_2$ group or a $=N$-Ph group (Ph represents a substituted or unsubstituted phenyl group; the same applies hereinafter); and $R^{201}$ and $R^{202}$ each independently represent a hydrogen atom, a halogen atom, a nitro group, a substituted or unsubstituted alkyl group or a substituted or unsubstituted alkoxy group.

(3)

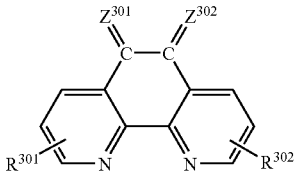

In the formula (3), $Z^{301}$ and $Z^{302}$ each independently represent an oxygen atom, a $=C(CN)_2$ group or a $=N$-Ph group; and $R^{301}$ and $R^{302}$ each independently represent a hydrogen atom, a halogen atom, a nitro group, a substituted or unsubstituted alkyl group or a substituted or unsubstituted alkoxy group.

(4)

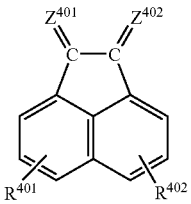

In the formula (4), $Z^{401}$ and $Z^{402}$ each independently represent an oxygen atom, a $=C(CN)_2$ group or a $=N$-Ph group;

and $R^{401}$ and $R^{402}$ each independently represent a hydrogen atom, a halogen atom, a nitro group, a substituted or unsubstituted alkyl group or a substituted or unsubstituted alkoxy group.

The alkyl group in the above may include chain alkyl groups such as a methyl group, an ethyl group and a propyl group, and cyclic alkyl groups such as a cyclohexyl group and a cycloheptyl group. The halogen atom in the above may include a fluorine atom, a chlorine atom and a bromine atom. The alkoxy group in the above may include a methoxy group, an ethoxy group and a propoxy group.

The substituent each of the above substituted or unsubstituted groups may have may include alkyl groups such as a methyl group, an ethyl group, a propyl group, a cyclohexyl group and a cycloheptyl group; alkenyl groups such as a vinyl group and an allyl group; a nitro group; halogen atom such as a fluorine atom, a chlorine atom and a bromine atom; halogenated alkyl groups such as a perfluoroalkyl group; aryl groups such as a phenyl group, a naphthyl group and an anthryl group; aralkyl group such as a benzyl group and a phenethyl group; and alkoxy groups such as a methoxy group, an ethoxy group and a propoxy group.

Of the phenanthrene compound having a structure represented by the above formula (2), preferred are those having a reduction potential (reduction potential with respect to a saturated calomel electrode) of −0.80 V or more, particularly −0.65 V or more, and more preferably −0.60 V or more, and on the other hand 0.00 V or less, and more preferably −0.25 V or less.

Of the phenanthroline compound having the structure represented by the above formula (3), preferred are those having a reduction potential (reduction potential with respect to a saturated calomel electrode) in the range of from −0.80 V to 0.00 V, particularly in the range of from −0.65 V to −0.25 V, and more preferably in the range of from −0.60 V to −0.25 V.

Of the acenaphthene compound having the structure represented by the above formula (4), preferred are those having a reduction potential (reduction potential with respect to a saturated calomel electrode) in the range of from −0.80 V to 0.00 V, particularly in the range of from −0.65 V to −0.25 V, and more preferably in the range of from −0.60 V to −0.25 V.

Specific examples of the phenanthroline compound having the structure represented by the above formula (2) are shown below.

(2-1)

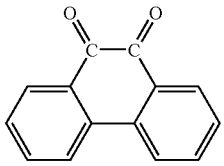

(2-2)

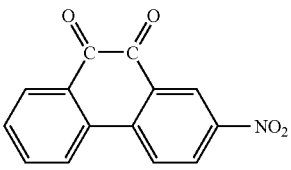

-continued (2-3)

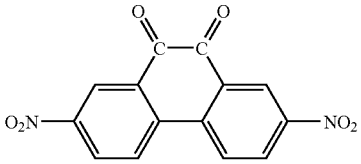

(2-4)

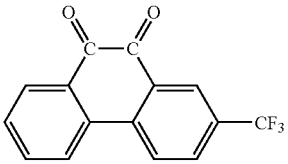

(2-5)

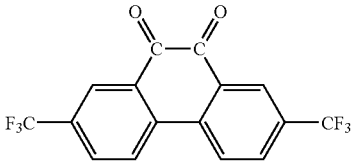

(2-6)

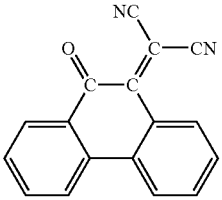

(2-7)

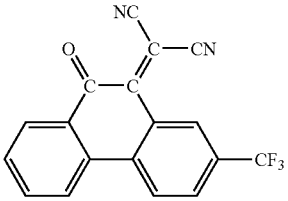

(2-8)

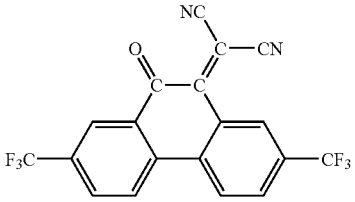

(2-9)

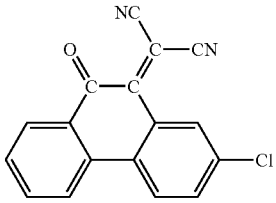

(2-10)

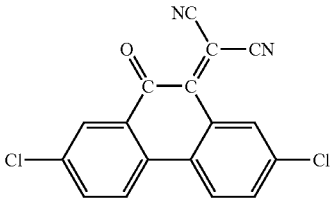

-continued
(2-11)
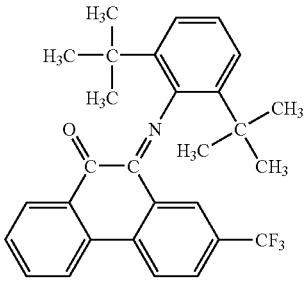
(2-12)
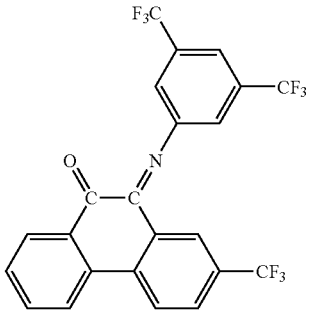
(2-13)
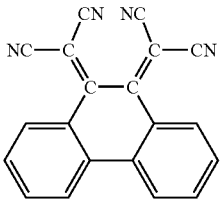
(2-14)
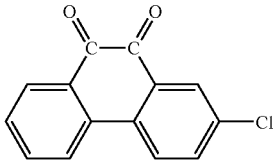
(2-15)
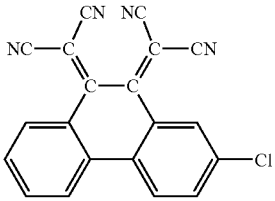
Specific examples of the phenanthroline compound having the structure represented by the above formula (3) are shown below.
(3-1)
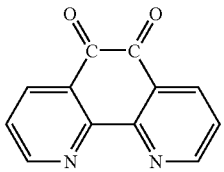
-continued
(3-2)
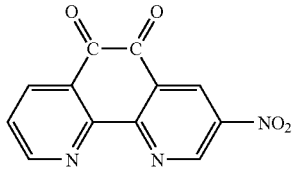
(3-3)
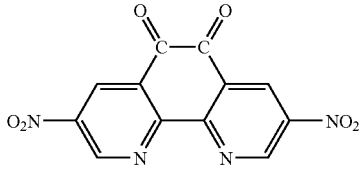
(3-4)
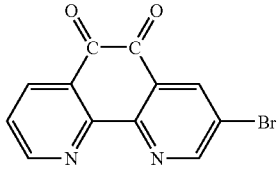
(3-5)
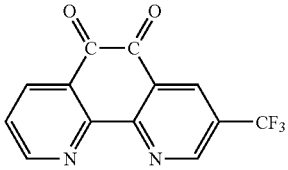
(3-6)
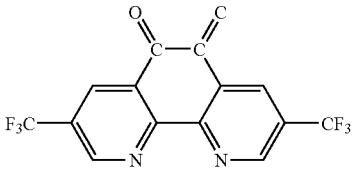
(3-7)
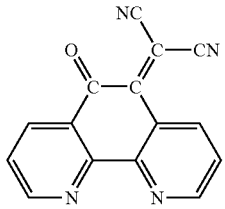
(3-8)
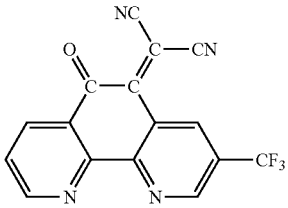
(3-9)
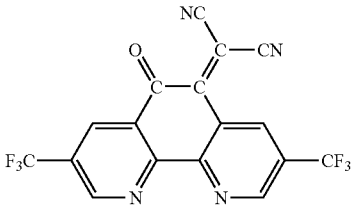

-continued
(3-10)
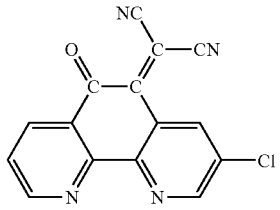
(3-11)
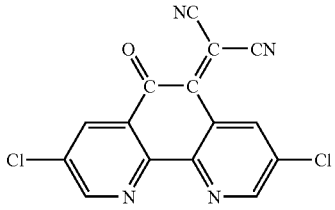
(3-12)
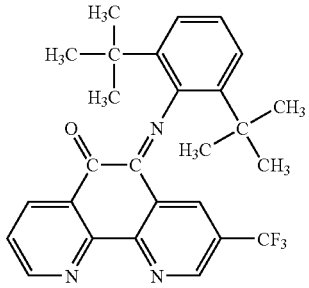
(3-13)
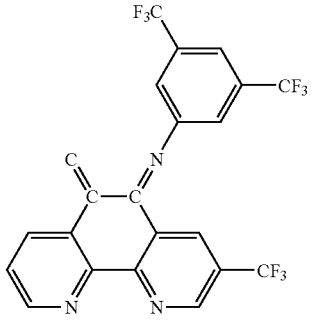
(3-14)
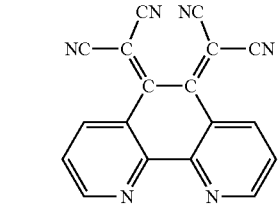
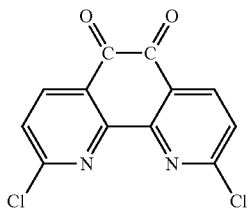
Specific examples of the acenaphthene compound having the structured represented by the above formula (4) are shown below.
(4-1)
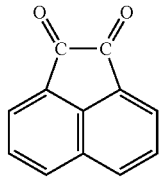
(4-2)
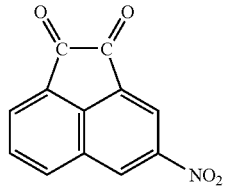
(4-3)
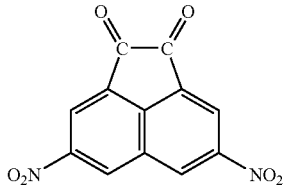
(4-4)
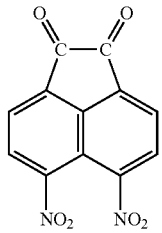
(4-5)
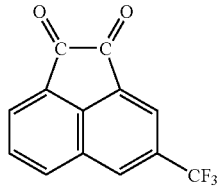
(4-6)
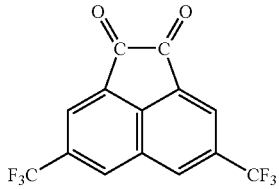
(4-7)
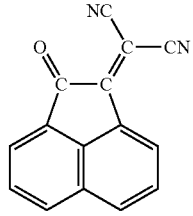

-continued (4-8)

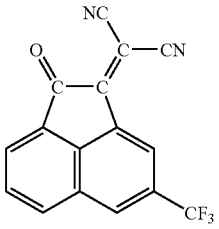

(4-9)

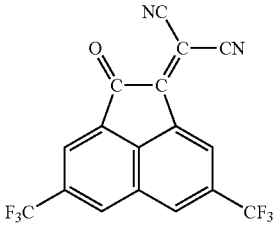

(4-10)

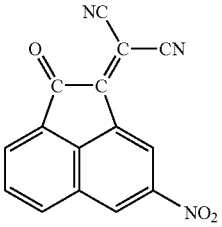

(4-11)

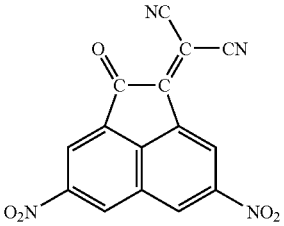

(4-12)

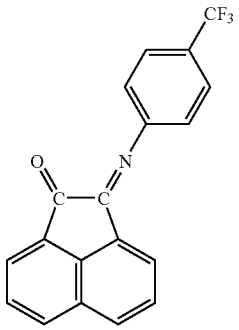

(4-13)

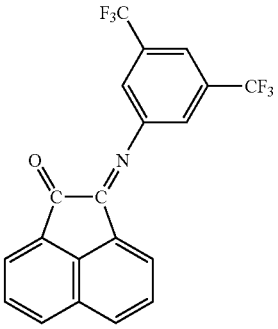

-continued (4-14)

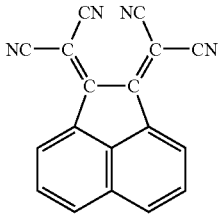

(4-15)

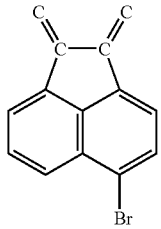

The phenanthrene compounds having structures represented by the above formulas (2-1) to (2-15), the phenanthroline compounds having structures represented by the above formulas (3-1) to (3-14) and the acenaphthene compounds having structures represented by the above formulas (4-1) to (4-14) have reduction potentials which are respectively as shown below.

(2-1): −0.67 V
(2-2): −0.52 V
(2-3): −0.32 V
(2-4): −0.58 V
(2-5): −0.51 V
(2-6): −0.28 V
(2-7): −0.23 V
(2-8): −0.21 V
(2-9): −0.26 V
(2-10): −0.24 V
(2-11): −0.58 V
(2-12): −0.55 V
(2-13): −0.19 V
(2-14): −0.65 V
(2-15): −0.18 V
(3-1): −0.52 v
(3-2): −0.37 V
(3-3): −0.28 V
(3-4): −0.40 V
(3-5): −0.38 V
(3-6): −0.35 V
(3-7): −0.22 V
(3-8): −0.20 V
(3-9): −0.18 V
(3-10): −0.21 V
(3-11): −0.20 V
(3-12): −0.37 V
(3-13): −0.36 V
(3-14): −0.15 V
(3-15): −0.34 V
(4-1): −0.90 V
(4-2): −0.60 V
(4-3): −0.40 V
(4-4): −0.40 V
(4-5): −0.65 V
(4-6): −0.58 V
(4-7) −0.42 V
(4-8): −0.39 V (4-9): −0.37 V
(4-10): −0.37 V
(4-11): −0.27 V
(4-12): −0.69 V
(4-13): −0.65 V
(4-14): −0.27 V
(4-15): −0.80 V

The electrophotographic photosensitive member of the present invention is constructed as described below.

As mentioned above, the electrophotographic photosensitive member of the present invention is an electrophotographic photosensitive member comprising a support, a charge generation layer containing a charge-generating material and a binder resin, provided on the support, and a hole transport layer containing a hole-transporting material, provided on the charge transport layer.

As the support, it may at least be one having conductivity (a conductive support). For example, usable are supports made of a metal (or made of an alloy) such as aluminum, nickel, copper, gold, iron, aluminum alloy or stainless steel. Also usable are the above supports made of a metal, supports made of a plastic (such as polyester resin, polycarbonate resin or polyimide resin) and supports made of glass, having a coating layer formed by vacuum deposition of aluminum, aluminum alloy, indium oxide-tin oxide alloy or the like. Still also usable are supports comprising plastic or paper impregnated with conductive fine particles such as carbon black, tin oxide particles, titanium oxide particles or silver particles together with a suitable binder resin, and supports made of a plastic containing a conductive binder resin. Also, as the shape of the support, it may include cylindrical and beltlike. A cylindrical support is preferred.

For the purpose of prevention of interference fringes caused by scattering of laser light or the like, the surface of the support may be subjected to cutting, surface roughening (such as honing or blasting) or aluminum anodizing, or may be subjected to chemical treatment with a solution prepared by dissolving a metal salt compound or a metal salt of a fluorine compound in an acidic aqueous solution composed chiefly of an alkali phosphate, phosphoric acid or tannic acid.

The honing includes dry honing and wet honing. The wet honing is a method in which a powdery abrasive is suspended in a liquid such as water and the suspension obtained is sprayed on the surface of the support at a high speed to roughen the surface of the support, where the surface roughness may be controlled by selecting spray pressure or speed, the quantity, type, shape, size, hardness or specific gravity of the abrasive, suspension temperature, and so forth. The dry honing is a method in which an abrasive is sprayed by air on the surface of the support at a high speed to roughen the surface of the support, where the surface roughness may be controlled in the same way as the wet honing. The abrasive used in the honing may include particles of silicon carbide, alumina, iron, and glass beads.

A conductive layer intended for the prevention of interference fringes caused by scattering of laser light or the like or for the covering of scratches of the support surface may be provided between the support and the charge generation layer or an intermediate layer described later.

The conductive layer may be formed with a dispersion prepared by dispersing conductive particles such as carbon black, metal particles or metal oxide particles in a binder resin. Preferable metal oxide particles may include particles of zinc oxide or titanium oxide. Also, as the conductive particles, particles of barium sulfate may be used. The conductive particles may be provided with coat layers.

The conductive particles may preferably have volume resistivity in the range of from 0.1 to 1,000 Ωcm, and, in particular, more preferably in the range of from 1 to 1,000 Ωcm (This volume resistivity is the value determined by measurement made using a resistance meter LORESTA AP, manufactured by Mitsubishi Chemical Corporation. A sample for measurement is one hardened at a pressure of 49 MPa so as to be made into a coin.). Also, the conductive particles may preferably have average particle diameter in the range of from 0.05 μm to 1.0 μm, and, in particular, more preferably in the range of from 0.07 μm to 0.7 μm (This average particle diameter is the value measured by centrifugal sedimentation.). The proportion of the conductive particles in the conductive layer may preferably be in the range of from 1.0 to 90% by weight, and, in particular, more preferably in the range of from 5.0 to 80% by weight, based on the total weight of the conductive layer.

The binder resin used in the conductive layer may include, e.g., phenol resins, polyurethane resins, polyamide resins, polyimide resins, polyamide-imide resins, polyamic acid resins, polyvinyl acetal resins, epoxy resins, acrylic resins, melamine resins and polyester resins. Any of these may be used alone or in the form of a mixture or copolymer of two or more types. These have good adhesion to the support, and also improve dispersibility of the conductive particles and have good solvent resistance after films have been formed. Of these, phenol resins, polyurethane resins and polyamic acid resins are preferred.

The conductive layer may preferably be in a layer thickness of from 0.1 μm to 30 μm, and, in particular, more preferably from 0.5 μm to 20 μm.

The conductive layer may preferably have a volume resistivity of $10^{13}$ Ωcm or less, and, in particular, more preferably in the range of from $10^{5}$ to $10^{12}$ Ωcm (This volume resistivity is the value determined by forming a coating film on an aluminum plate using the same material as the conductive layer on which the volume resistivity is to be measured, forming a thin gold film on this coating film, and measuring with a pA meter the value of electric current flowing across both electrodes, the aluminum plate and the thin gold film.).

The conductive layer may also optionally be incorporated with fluorine or antimony, or a leveling agent may be added to the conductive layer in order to improve its surface properties.

An intermediate layer (also called a subbing layer or an adhesion layer) having the function as a barrier and the function of adhesion may also be provided between the support or the conductive layer and the charge generation layer. The intermediate layer is formed for the purposes of, e.g., improving the adhesion of the photosensitive layer, improving coating performance, improving the injection of electric charges from the support and protecting the photosensitive layer from any electrical breakdown.

The intermediate layer may be formed using a resin such as acrylic resin, allyl resin, alkyd resin, ethyl cellulose resin, an ethylene-acrylic acid copolymer, epoxy resin, casein resin, silicone resin, gelatin resin, nylon, phenol resin, butyral resin, polyacrylate resin, polyacetal resin, polyamide-imide resin, polyamide resin, polyallyl ether resin, polyimide resin, polyurethane resin, polyester resin, polyethylene resin, polycarbonate resin, polystyrene resin, polysulfone resin, polyvinyl alcohol resin, polybutadiene resin, polypropylene resin or urea resin, or a material such as aluminum oxide.

The intermediate layer may preferably be in a layer thickness of 0.05 μm to 5 μm, and, in particular, more preferably from 0.3 μm to 3 μm.

The charge-generating material used in the electrophotographic photosensitive member of the present invention may include, e.g., azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts, thiapyrylium salts, triphenylmethane dyes, inorganic materials such as selenium, selenium-tellurium and amorphous silicon, quinacridone pigments, azulenium salt pigments, cyanine dyes, xanthene dyes, quinoneimine dyes, styryl dyes, cadmium sulfide, and zinc oxide. Any of these charge-generating materials may be used alone or in combination of two or more types.

Of the above various charge-generating materials, azo pigments and phthalocyanine pigments are preferred in that they have high sensitivity but on the other hand tend to cause the ghost phenomenon and hence the present invention may more effectively act thereon. Phthalocyanine pigments are particularly preferred. Where a phthalocyanine pigment and other charge-generating material are used in combination, it is preferable for the phthalocyanine pigment to be in an amount of 50% by weight or more based on the total weight of the charge-generating materials.

Of the phthalocyanine pigments, metal phthalocyanine pigments are preferred. In particular, oxytitanium phthalocyanine, chlorogallium phthalocyanine, dichlorotin phthalocyanine and hydroxygallium phthalocyanine are preferred. Of these, hydroxygallium phthalocyanine is particularly preferred.

As the oxytitanium phthalocyanine, preferred are oxytitanium phthalocyanine crystals with a crystal form having strong peaks at Bragg angles 2θ plus-minus 0.2° of 9.0°, 14.2°, 23.9° and 27.1° in CuKα characteristic X-ray diffraction, and oxytitanium phthalocyanine crystals with a crystal form having strong peaks at Bragg angles 2θ plus-minus 0.2° of 9.5°, 9.7°, 11.7°, 15.0°, 23.5°, 24.1° and 27.3° in CuKα characteristic X-ray diffraction.

As the chlorogallium phthalocyanine, preferred are chlorogallium phthalocyanine crystals with a crystal form having strong peaks at Bragg angles 2θ plus-minus 0.2° of 7.4°, 16.6°, 25.5° and 28.2° n CuKα characteristic X-ray diffraction, chlorogallium phthalocyanine crystals with a crystal form having strong peaks at Bragg angles 2θ plus-minus 0.2° of 6.8°, 17.3°, 23.6° and 26.9° in CuKα characteristic X-ray diffraction, and chlorogallium phthalocyanine crystals with a crystal form having strong peaks at Bragg angles 2θ plus-minus 0.2° of 8.7° to 9.2°, 17.6°, 24.0°, 27.4° and 28.8° in CuKα characteristic X-ray diffraction.

As the dichlorotin phthalocyanine, preferred are dichlorotin phthalocyanine crystals with a crystal form having strong peaks at Bragg angles 2θ plus-minus 0.2° of 8.3°, 12.2°, 13.7°, 15.9°, 18.9° and 28.2° in CuKα characteristic X-ray diffraction, dichlorotin phthalocyanine crystals with a crystal form having strong peaks at Bragg angles 2θ plus-minus 0.2° of 8.5°, 11.2°, 14.5° and 27.2° in CuKα characteristic X-ray diffraction, dichlorotin phthalocyanine crystals with a crystal form having strong peaks at Bragg angles 2θ plus-minus 0.2° of 8.7°, 9.9°, 10.9°, 13.1°, 15.2°, 16.3°, 17.4°, 21.9° and 25.5° in CuKα characteristic X-ray diffraction, and dichlorotin phthalocyanine crystals with a crystal form having strong peaks at Bragg angles 2θ plus-minus 0.2° of 9.2°, 12.2°, 13.4°, 14.6°, 17.0° and 25.30 in CuKα characteristic X-ray diffraction.

As the hydroxygallium phthalocyanine, preferred are hydroxygallium phthalocyanine crystals with a crystal form having strong peaks at Bragg angles 2θ plus-minus 0.2° of 7.3°, 24.9° and 28.1° in CuKα characteristic X-ray diffraction, and hydroxygallium phthalocyanine crystals with a crystal form having strong peaks at Bragg angles 2θ plus-minus 0.2° of 7.5°, 9.9°, 12.5°, 16.3°, 18.6°, 25.1° and 28.3° in CuKα characteristic X-ray diffraction.

The charge-generating material may preferably have particle diameters of 0.5 μm or less, and, in particular, more preferably 0.3 μm or less, and still more preferably from 0.01 μm to 0.2 μm.

The binder resin used in the charge generation layer may include, e.g., acrylic resins, allyl resins, alkyd resins, epoxy resins, diallyl phthalate resins, silicone resins, styrene-butadiene copolymers, cellulose resins, nylons, phenol resins, butyral resins, benzal resins, melamine resins, polyacrylate resins, polyacetal resins, polyamide-imide resins, polyamide resins, polyallyl ether resins, polyarylate resins, polyimide resins, polyurethane resins, polyester resins, polyethylene resins, polycarbonate resins, polystyrene resins, polysulfone resins, polyvinyl acetal resins, polyvinyl methacrylate resins, polyvinyl acrylate resins, polybutadiene resins, polypropylene resins, methacrylic resins, urea resins, vinyl chloride-vinyl acetate copolymers, vinyl acetate resins and vinyl chloride resins. In particular, butyral resins or the like are preferred. Any of these may be used alone or in the form of a mixture or copolymer of two or more types.

In the present invention, the charge generation layer of the electrophotographic photosensitive member is incorporated with the phenanthrene compound having the structure represented by the above formula (2), the phenanthroline compound having the structure represented by the above formula (3) or the acenaphthene compound having the structure represented by the above formula (4).

The reason is unclear in detail why the incorporation in the charge generation layer with the phenanthrene compound having the structure represented by the above formula (2), the phenanthroline compound having the structure represented by the above formula (3) or the acenaphthene compound having the structure represented by the above formula (4) can keep the ghost from occurring. The present inventors presumes it as stated below.

That is, the ghost phenomenon is a phenomenon which is caused by the potential difference that comes after irradiation with exposure light at the time of next drum rotation because of a difference between the number of electrons remaining at areas having been irradiated with exposure light (imagewise exposure light) and the number of electrons remaining at areas having not been irradiated with exposure light.

Electric charges (holes and electrons) are generated by the charge-generating material upon irradiation by exposure light. Where the charge generation layer is a layer containing the charge-generating material and the binder resin, the holes and electrons having been separated move on through the interior of the binder resin, and hence are considered to greatly take over the properties of the binder resin. In the case of the electrophotographic photosensitive member comprising a charge generation layer and provided thereon a hole transport layer, i.e., a negatively chargeable multi-layer type electrophotographic photosensitive member as in the present invention, the holes continue to be injected into the hole transport layer, whereas the electrons tend to remain in the binder resin of the charge generation layer, and cause the potential difference to make the ghost phenomenon occur.

In the present invention, the charge generation layer is incorporated with the phenanthrene compound having the structure represented by the above formula (2), the phenanthroline compound having the structure represented by the above formula (3) or the acenaphthene compound having the structure represented by the above formula (4). This compound is what is called an electron transporting material, which has electron transporting ability, and hence it can lower the level of electrons remaining in the binder resin of the charge generation layer, as so considered.

It is also considered that the electrons move on through the interior of the binder resin, and is considered that the effect of keeping the ghost phenomenon from occurring can be obtained by smoothing such movement of electrons. Accordingly, the phenanthrene compound having the structure represented by the above formula (2), the phenanthroline compound having the structure represented by the above formula (3) or the acenaphthene compound having the structure represented by the above formula (4) may preferably be made so present as to stand molecular dispersion in the binder resin. The phenanthrene compound having the structure represented by the above formula (2), the phenanthroline compound having the structure represented by the above formula (3) or the acenaphthene compound having the structure represented by the above formula (4) may also preferably be in a content of from 15 to 120% by weight, and, in particular, more preferably from 51 to 80% by weight, based on the weight of the binder resin in the charge generation layer. If it is in a too small content, the effect of keeping the ghost phenomenon from occurring may come poor.

To form such a charge generation layer, the phenanthrene compound having the structure represented by the above formula (2), the phenanthroline compound having the structure represented by the above formula (3) or the acenaphthene compound having the structure represented by the above formula (4) may be added (preferably in an amount of from 15 to 120% by weight, and more preferably from 51 to 80% by weight, based on the weight of the binder resin) to a fluid prepared by dispersing or dissolving the charge-generating material and the binder resin in a solvent, to make up a charge generation layer coating fluid, and this charge generation layer coating fluid may be coated, followed by drying. The coating fluid containing the charge-generating material, the binder resin and the solvent is obtained by subjecting the charge-generating material to dispersion together with the binder resin and the solvent. As methods for the dispersion, a method is available which makes use of a homogenizer, an ultrasonic dispersion machine, a ball mill, a sand mill, a roll mill, a vibration mill, an attritor or a liquid impact type high-speed dispersion machine. The charge-generating material and the binder resin may preferably be in a proportion ranging from 1:0.3 to 1:4 (weight ratio).

As the solvent used for the charge generation layer coating fluid, it may be selected from the viewpoint of the binder resin or the charge-generating material to be used and the solubility or dispersion stability of the phenanthrene compound having the structure represented by the above formula (2), the phenanthroline compound having the structure represented by the above formula (3) or the acenaphthene compound having the structure represented by the above formula (4). As an organic solvent, it may include alcohols, sulfoxides, ketones, ethers, esters, aliphatic halogenated hydrocarbons, and aromatic compounds.

The charge generation layer may preferably be in a layer thickness of 5 μm or less, and, in particular, more preferably from 0.1 μm to 2 μm.

To the charge generation layer, a sensitizer, an antioxidant, an ultraviolet absorber, a plasticizer and so forth which may be of various types may also optionally be added.

The hole-transporting material used in the electrophotographic photosensitive member of the present invention may include, e.g., triarylamine compounds, hydtazone compounds, styryl compounds, stilbene compounds, pyrazoline compounds, oxazole compounds, thiazole compounds and triarylmethane compounds. Any of these hole-transporting materials may be used alone or in combination of two or more types.

A binder resin used in the hole transport layer may include, e.g., acrylic resins, acrylonitrile resins, allyl resins, alkyd resins, epoxy resins, silicone resins, nylons, phenol resins, phenoxy resins, butyral resins, polyacrylamide resins, polyacetal resins, polyamide-imide resins, polyamide resins, polyallyl ether resins, polyarylate resins, polyimide resins, polyurethane resins, polyester resins, polyethylene resins, polycarbonate resins, polystyrene resins, polysulfone resins, polyvinyl butyral resins, polyphenylene oxide resins, polybutadiene resins, polypropylene resins, methacrylic resins, urea resins, vinyl chloride resins and vinyl acetate resins. Of these, polyarylate resins and polycarbonate resins are preferred. In particular, polyarylate resins are more preferred.

Of the polyarylate resins, preferred is a polyarylate resin having a repeating unit represented by the following formula (5).

(5)

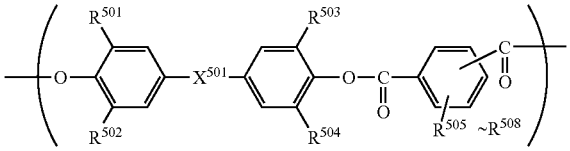

In the formula (5), $X^{501}$ represents a single bond or —$CR^{509}R^{510}$— ($R^{509}$ and $R^{510}$ each independently represent a hydrogen atom, a halogen atom, a substituted or unsubstituted alkyl group or a substituted or unsubstituted aryl group, or an alkylidene group formed by combining $R^{509}$ and $R^{510}$); $R^{501}$ to $R^{504}$ each independently represent a hydrogen atom, a halogen atom, a substituted or unsubstituted alkyl group or a substituted or unsubstituted aryl group; and $R^{505}$ to $R^{508}$ each independently represent a hydrogen atom, a halogen atom, a substituted or unsubstituted alkyl group or a substituted or unsubstituted aryl group.

The binder resin may preferably have a weight-average molecular weight of from 50,000 to 200,000, and particularly preferably from 100,000 to 180,000.

In the present invention, the weight-average molecular weight is determined by measuring molecular weight distribution by the use of a gel permeation chromatograph HLC-8120, available from Toso Corporation, followed by calculation in terms of polystyrene. As a developer, tetrahydrofuran (THF) is used. A sample to be measured is a 0.1% by weight solution. As a column, used is a column having a molecular weight cutoff (in terms of polystyrene) of 4,000,000 (trade name: TSKgel Super HM-N, available from Toso Corporation). As a detector, an RI detector is used. Column temperature is set to 40° C. Injection is in an amount of 20 μl. Flow rate is 1.0 ml/min.

The above resins may be used alone or in the form of a mixture or copolymer of two or more types.

The hole transport layer may be formed by coating a hole transport layer coating solution prepared by dissolving the hole-transporting material and the binder resin in a solvent, followed by drying. The hole-transporting material and the binder resin may preferably be in a proportion ranging from 2:1 to 1:2 (weight ratio).

As the solvent used for the hole transport layer coating solution, usable are ketones such as acetone and methyl ethyl ketone, esters such as methyl acetate and ethyl acetate, aromatic hydrocarbons such as toluene and xylene, ethers such as 1,4-dioxane and tetrahydrofuran, and hydrocarbons substituted with a halogen atom, such as chlorobenzene, chloroform and carbon tetrachloride.

The hole transport layer may preferably be in a layer thickness of from 5 μm to 40 μm, and, in particular, more preferably from 10 μm to 30 μm.

A protective layer intended for the protection of the hole transport layer may also be provided on the hole transport layer. The protective layer may be formed by coating a protective layer coating solution obtained by dissolving a binder resins in a solvent, followed by drying. The protective layer may also be formed by coating a protective layer coating solution obtained by dissolving a binder resin monomer or oligomer in a solvent, followed by curing and/or drying. To effect the curing, light, heat or radiations (such as electron rays) may be used.

As the binder resin for the protective layer, every king of resin described above may be used.

In the protective layer, conductive particles such as conductive tin oxide-particles or conductive titanium oxide particles may also be dispersed for the purpose of controlling its resistivity.

The protective layer may preferably be in a layer thickness of from 0.2 μm to 10 μm, and, in particular, preferably from 1 μm to 5 μm.

When the coating solutions for the above various layers are coated, usable are coating methods as exemplified by dip coating, spray coating, spinner coating, roller coating, Mayer bar coating and blade coating.

A surface layer of the electrophotographic photosensitive member may also be incorporated with a lubricant such as polytetrafluoroethylene, polyvinylidene fluoride, a fluorine type graft polymer, a silicone type graft polymer, a fluorine type block polymer, a silicone type block polymer or a silicone type oil for the purpose of improving cleaning performance and wear resistance. An antioxidant such as hindered phenol or hindered amine may also be added thereto for the purpose of improving weatherability, and a film strength reinforcing agent such as silicone balls may also be added in order to enhance strength.

Incidentally, where the protective layer is formed, the protective layer is the surface layer of the electrophotographic photosensitive member, and, where the protective layer is not formed, the hole transport layer is the surface layer of the electrophotographic photosensitive member.

FIG. 1 schematically illustrates an example of the construction of an electrophotographic apparatus provided with a process cartridge having the electrophotographic photosensitive member of the present invention.

In FIG. 1, reference numeral 1 denotes a cylindrical electrophotographic photosensitive member, which is rotatingly driven around an axis 2 in the direction of an arrow at a stated peripheral speed.

The surface of the electrophotographic photosensitive member 1 rotatingly driven is uniformly electrostatically charged to a positive or negative, given potential through a charging means (primary charging means such as a charging roller) 3. The electrophotographic photosensitive member thus charged is then exposed to exposure light (imagewise exposure light) 4 emitted from an exposure means (not shown) for slit exposure, laser beam scanning exposure or the like. In this way, electrostatic latent images corresponding to the intended image are successively formed on the surface of the electrophotographic photosensitive member 1.

The electrostatic latent images thus formed on the surface of the electrophotographic photosensitive member 1 are developed with a toner contained in a developer a developing means 5 has, to form toner images. Then, the toner images thus formed and held on the surface of the electrophotographic photosensitive member 1 are successively transferred by applying a transfer bias from a transfer means (such as a transfer roller) 6, which are transferred on to a transfer material (such as paper) P fed from a transfer material feed means (not shown) to the part (contact zone) between the electrophotographic photosensitive member 1 and the transfer means 6 in the manner synchronized with the rotation of the electrophotographic photosensitive member 1.

The transfer material P to which the toner images have been transferred is separated from the surface of the electrophotographic photosensitive member 1, is led through a fixing means 8, where the toner images are fixed, and is then put out of the apparatus as an image-formed material (a print or a copy).

The surface of the electrophotographic photosensitive member 1 from which toner images have been transferred is brought to removal of the developer (toner) remaining after the transfer, through a cleaning means (such as a cleaning blade) 7. Thus, its surface is cleaned. It is further subjected to destaticization by pre-exposure light (not shown) emitted from a pre-exposure means (not shown), and thereafter repeatedly used for the formation of images. Incidentally, where as shown in FIG. 1 the primary charging means 3 is a contact charging means making use of a charging roller or the like, the pre-exposure is not necessarily required.

The apparatus may be constituted of a combination of plural components integrally joined in a container as a process cartridge from among the constituents such as the above electrophotographic photosensitive member 1, charging means 3, developing means 5, transfer means 6 and cleaning means 7 so that the process cartridge is set detachably mountable to the main body of an electrophotographic apparatus such as a copying machine or a laser beam printer. In the apparatus shown in FIG. 1, the electrophotographic photosensitive member 1 and the charging means 3, developing means 5 and cleaning means 7 are integrally supported to form a cartridge to set up a process cartridge 9 that is detachably mountable to the main body of the electrophotographic apparatus through a guide means 10 such as rails provided in the main body of the electrophotographic apparatus.

Figure 2:
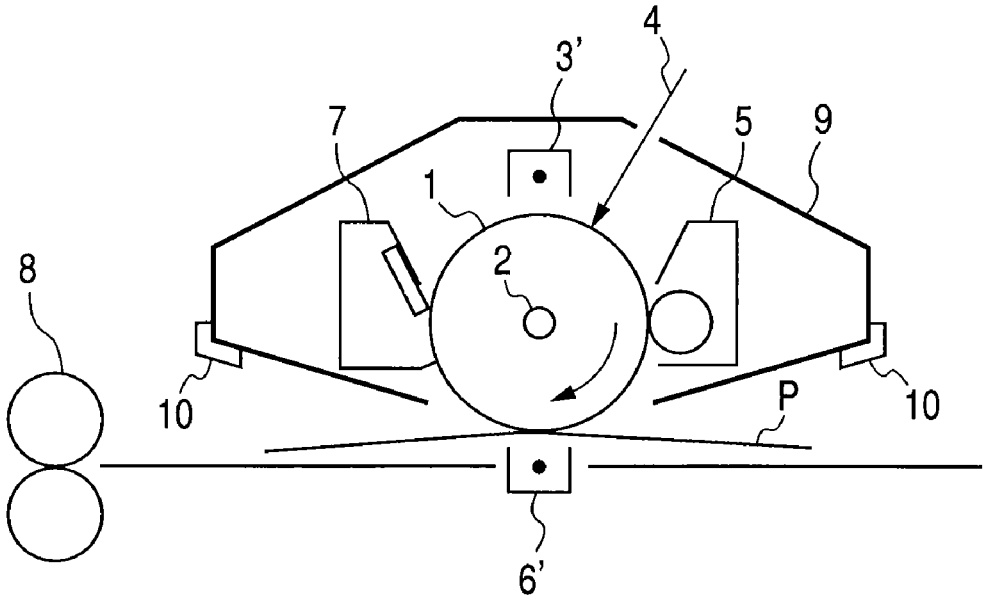
FIG. 2 is a schematic view showing another example of the construction of an electrophotographic apparatus provided with a process cartridge having the electrophotographic photosensitive member of the present invention.

FIG. 2 schematically illustrates another example of the construction of an electrophotographic apparatus provided with a process cartridge having the electrophotographic photosensitive member of the present invention.

The electrophotographic apparatus shown in FIG. 2 has a charging means 3' making use of a corona discharge assembly, and a transfer means 6' making use of a corona discharge assembly. As to how it operates, it does like the electrophotographic apparatus constructed as shown in FIG. 1.

EXAMPLES

The present invention is described below in greater detail by giving specific working examples. The present invention, however, is by no means limited to these. In the following examples, "part(s)" refers to "part(s) by weight".

Synthesis Example 1

Synthesis of Hydroxygallium Phthalocyanine 73 g of o-phthalodinitrile, 25 g of gallium trichloride and 400 ml of α-chloronaphthalene were allowed to react at 200°

C. for 4 hours in an atmosphere of nitrogen, and thereafter the product formed was filtered at 130° C. The product thus filtered was subjected to dispersion and washing at 130° C. for 1 hour using N,N'-dimethylformamide, and then further washed with methanol, followed by drying to obtain 45 g of chlorogallium phthalocyanine.

15 g of the chlorogallium phthalocyanine obtained was dissolved in 450 g of concentrated sulfuric acid kept at 10° C., and this was dropwise added to 2,300 g of ice water to effect reprecipitation, followed by filtration. What was obtained by filtration was subjected to dispersion and washing with 1% ammonia water, and thereafter well washed with iron-exchanged water, followed by filtration and then drying to obtain 13 g of hydroxygallium phthalocyanine.

As the step of pigmentation, 10 g of the hydroxygallium phthalocyanine obtained and 300 g of N,N'-dimethylformamide were treated by milling at room temperature (22° C.) for 6 hours, together with 450 g of glass beads of 1 mm in diameter.

After the milling treatment, solid matter was taken out of the resultant fluid dispersion, and was thoroughly washed with methanol and then with water, followed by drying to obtain 9.2 g of hydroxygallium phthalocyanine crystals. This hydroxygallium phthalocyanine had strong peaks at Bragg angles 2θ plus-minus 0.2° of 7.3°, 24.9° and 28.1° in CuKα characteristic X-ray diffraction.

Example 1

An aluminum crude tube (ED tube) of A3003 (JIS) of 30.5 mm in outer diameter, 28.5 mm in inner diameter and 260.5 mm in length which was obtained by hot extrusion was used as a support.

Next, 120 parts of barium sulfate particles having coat layers formed of tin oxide (coverage: 50% by weight; powder resistivity: 700 Ωcm), 70 parts of resol type phenol resin (trade name: PLYOPHEN J-325, available from Dainippon Ink & Chemicals, Incorporated: solid content: 70%) and 100 parts of 2-methoxy-1-propanol were subjected to dispersion for 20 hours by means of a ball mill to prepare a conductive layer coating dispersion (the barium sulfate particles in the coating dispersion was 0.22 μm in average particle diameter).

This conductive layer coating dispersion was dip-coated on the support, followed by curing (heat curing) at 140° C. for 30 minutes to form a conductive layer with a layer thickness of 10 μm.

Next, 3 parts of N-methoxymethylated nylon and 3 parts of copolymer nylon were dissolved in a mixed solvent of 65 parts of methanol and 30 parts of n-butanol to prepare an intermediate layer coating solution.

This intermediate layer coating solution was dip-coated on the conductive layer, followed by drying at 90° C. for 5 minutes to form an intermediate layer with a layer thickness of 0.8 μm.

Next, 20 parts of hydroxygallium phthalocyanine crystals with a crystal form having strong peaks at Bragg angles 2θ plus-minus 0.2° of 7.3°, 24.9° and 28.1° in CuKα characteristic X-ray diffraction (a charge-generating material), 10 parts of polyvinyl butyral resin (trade name: S-LEC BX-1, available from Sekisui Chemical Co., Ltd.) and 350 parts of cyclohexanone were subjected to dispersion for 3 hours by means of a sand mill making use of glass beads of 1 mm in diameter, and then 1,200 parts of ethyl acetate was added (at this point, the charge-generating material was 0.15 μM in dispersed-particle diameter as measured with CAPA700, manufactured by Horiba Ltd.). To the mixture obtained, 6 parts of a phenanthrene compound having a structure represented by the above formula (2-1) (an electron transporting material) was dissolved to prepare a charge generation layer coating dispersion).

This charge generation layer coating dispersion was dip-coated on the intermediate layer, followed by drying at 100° C. for 10 minutes to form a charge generation layer with a layer thickness of 0.13 μm.

Next, 7 parts of a compound having structure represented by the following formula (6) (a hole-transporting material):

(6)

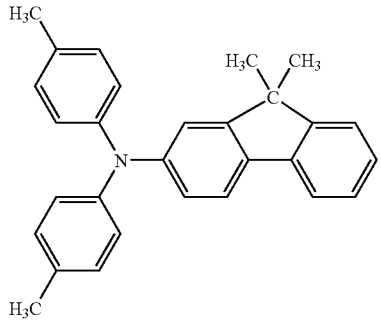

1 part of a compound having structure represented by the following formula (7) (a hole-transporting material):

(7)

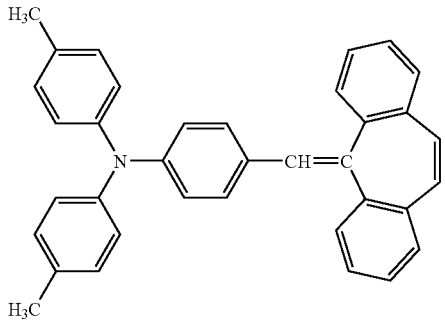

and 10 parts of polyarylate resin having a repeating structural unit represented by the following formula (8) (bisphenol C type; weight ratio of terephthalic acid skeleton to isophthalic acid skeleton: terephthalic acid:isophthalic acid=50:50):

(8)

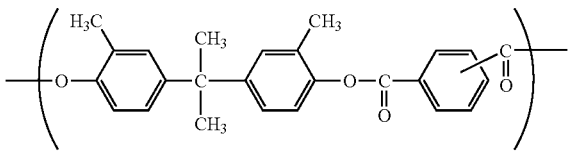

were dissolved in a mixed solvent of 50 parts of monochlorobenzene and 10 parts of dichloromethane to prepare a hole transport layer coating solution.

This hole transport layer coating solution was dip-coated on the charge generation layer, followed by drying at 110° C. for 1 hour to form a hole transport layer with a layer thickness of 23 μm.

Thus, an electrophotographic photosensitive member was produced, having the support, the conductive layer, the intermediate layer, the charge generation layer and the hole transport layer in this order; the hole transport layer being a surface layer.

The electrophotographic photosensitive member thus produced was set in the following evaluation apparatus, and images were reproduced to make evaluation of reproduced images.

Evaluation Apparatus:

The evaluation apparatus is an altered machine (set to process speed: 90 mm/s and dark-area potential: −700 V) of a laser beam printer "COLOR LASER JET 4600", manufactured by Hewlett-Packard Co. The charging means of this laser beam printer is a contact charging means having a charging roller, and a voltage of only DC voltage is applied to the charging roller. The amount of light of exposure light (image-wise exposure light) was set variable. Pre-exposure was set OFF.

Figure 3:
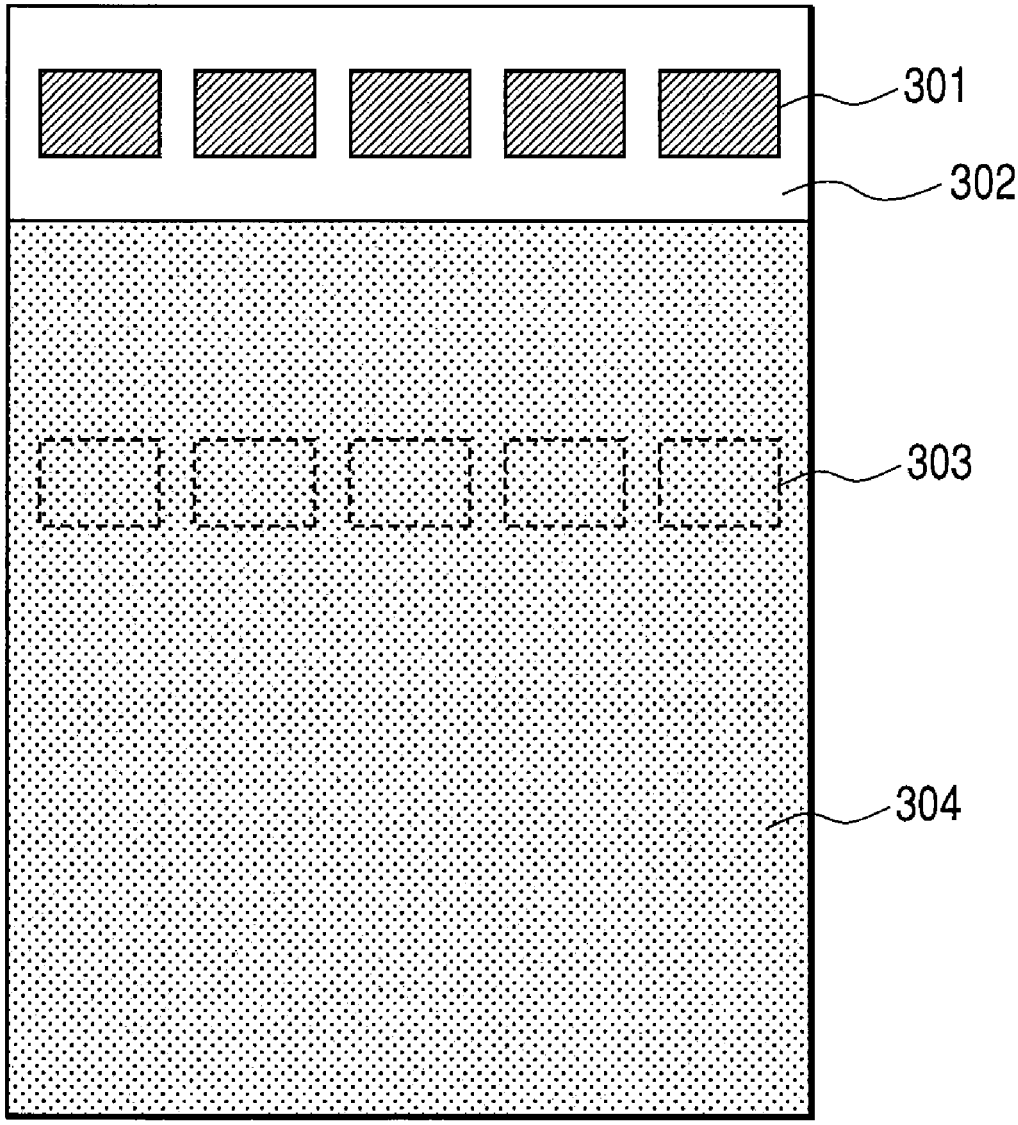
FIG. 3 shows an image pattern for evaluation.

Image Pattern for Evaluation:

As an image pattern for evaluation, a pattern for ghosts as shown in FIG. 3 was prepared for evaluation. In FIG. 3, areas 301 (black rectangles) are solid black, an area 302 is solid white, areas 303 are areas where ghosts coming from the solid black areas 301 may appear, and 304 denotes a halftone (dots arranged in keima pattern) area. This pattern was prepared for each monochrome of magenta, cyan, yellow and black.

Evaluation Method:

In an environment of 23° C./50% RH, an image with an image density of 4% was reproduced on 2,000 sheets, and thereafter evaluation was made using each pattern for ghosts.

First, a solid white image was reproduced on the 1st sheet, and then the above pattern for ghosts was continuously reproduced on 5 sheets. Next, a solid black image was reproduced on 1 sheet, and then the above pattern for ghosts was again continuously reproduced on 5 sheets. Thus, the pattern for ghosts was reproduced on 10 sheets in total.

To make evaluation on ghosts, a spectral densitometer X-Rite 504/508, manufactured by X-Rite was used. In images of the pattern for ghosts, the density of the halftone area 304 and the density of the areas 303 where ghosts may appear were measured to find density difference by subtracting the former density from the latter density. This measurement was made on 10 spots to find an average value of the values at 10 spots (average value per sheet). This value was found on 10 sheets to find an average value of those on 10 sheets (10-sheet average value). Further, this value was found on all the four colors (magenta, cyan, yellow and black) to find an average value of those for four colors (four-color average value). The results of measurement on each color were indicated for each of magenta, cyan, yellow and black on the spectral densitometer X-Rite 504/508, where the value of the same color as the color of the image was regarded as the measured value. If the density difference is less than 0.05, it can be said that there is substantially no problem on images. Where, however, a high image quality is required, the density difference may preferably be less than 0.03. Where further high printing speed and high image quality are required, the density difference may more preferably be less than 0.02. The results are shown in Table 1.

Example 2

An electrophotographic photosensitive member was produced in the same manner as in Example 1 except that, in Example 1, 6 parts of the phenanthrene compound having the structure represented by the above formula (2-1), used in the charge generation layer, was changed for 6 parts of a phenanthrene compound having a structure represented by the above formula (2-4). Evaluation was made in the same way. The results are shown in Table 1.

Example 3

An electrophotographic photosensitive member was produced in the same manner as in Example 1 except that, in Example 1, 6 parts of the phenanthrene compound having the structure represented by the above formula (2-1), used in the charge generation layer, was changed for 6 parts of a phenanthrene compound having a structure represented by the above formula (2-6). Evaluation was made in the same way. The results are shown in Table 1.

Example 4

An electrophotographic photosensitive member was produced in the same manner as in Example 1 except that, in Example 1, 6 parts of the phenanthrene compound having the structure represented by the above formula (2-1), used in the charge generation layer, was changed for 6 parts of a phenanthrene compound having a structure represented by the above formula (2-14). Evaluation was made in the same way. The results are shown in Table 1.

Example 5

An electrophotographic photosensitive member was produced in the same manner as in Example 1 except that, in Example 1, 6 parts of the phenanthrene compound having the structure represented by the above formula (2-1), used in the charge generation layer, was changed for 6 parts of a phenanthroline compound having a structure represented by the above formula (3-4). Evaluation was made in the same way. The results are shown in Table 1.

Example 6

An electrophotographic photosensitive member was produced in the same manner as in Example 1 except that, in Example 1, 6 parts of the phenanthrene compound having the structure represented by the above formula (2-1), used in the charge generation layer, was changed for 6 parts of a phenanthroline compound, having a structure represented by the above formula (3-15). Evaluation was made in the same way. The results are shown in Table 1.

Example 7

An electrophotographic photosensitive member was produced in the same manner as in Example 1 except that, in Example 1, 6 parts of the phenanthrene compound having the structure represented by the above formula (2-1), used in the charge generation layer, was changed for 6 parts of an acenaphthene compound having a structure represented by the above formula (4-1). Evaluation was made in the same way. The results are shown in Table 1.

Example 8

An electrophotographic photosensitive member was produced in the same manner as in Example 1 except that, in Example 1, 6 parts of the phenanthrene compound having the structure represented by the above formula (2-1), used in the charge generation layer, was changed for 6 parts of an acenaphthene compound having a structure represented by the above formula (4-7). Evaluation was made in the same way. The results are shown in Table 1.

Example 9

An electrophotographic photosensitive member was produced in the same manner as in Example 1 except that, in Example 1, 6 parts of the phenanthrene compound having the structure represented by the above formula (2-1), used in the charge generation layer, was changed for 6 parts of an acenaphthene compound having a structure represented by the above formula (4-15). Evaluation was made in the same way. The results are shown in Table 1.

Example 10

An electrophotographic photosensitive member was produced in the same manner as in Example 1 except that, in Example 1, 20 parts of the hydroxygallium phthalocyanine crystals with a crystal form having strong peaks at Bragg angles 2θ plus-minus 0.2° of 7.3°, 24.9° and 28.1° in CuKα characteristic X-ray diffraction, used in the charge generation layer, was changed for 20 parts of chlorogallium phthalocyanine crystals with a crystal form having strong peaks at Bragg angles 2θ plus-minus 0.2° of 7.4°, 16.6°, 25.5° and 28.2° in CuKα characteristic X-ray diffraction. Evaluation was made in the same way. The results are shown in Table 1.

Example 11

An electrophotographic photosensitive member was produced in the same manner as in Example 1 except that, in Example 1, 20 parts of the hydroxygallium phthalocyanine crystals with a crystal form having strong peaks at Bragg angles 2θ plus-minus 0.2° of 7.3°, 24.9° and 28.1° in CuKα characteristic X-ray diffraction, used in the charge generation layer, was changed for 20 parts of oxytitanium phthalocyanine crystals with a crystal form having strong peaks at Bragg angles 2θ plus-minus 0.2° of 9.0°, 14.2°, 23.9° and 27.1° in CuKα characteristic X-ray diffraction. Evaluation was made in the same way. The results are shown in Table 1.

Example 12

An electrophotographic photosensitive member was produced in the same manner as in Example 1 except that, in Example 1, 20 parts of the hydroxygallium phthalocyanine crystals with a crystal form having strong peaks at Bragg angles 2θ plus-minus 0.2° of 7.3°, 24.9° and 28.1° in CuKα characteristic X-ray diffraction, used in the charge generation layer, was changed for 20 parts of an azo compound having a structure represented by the following formula (9):

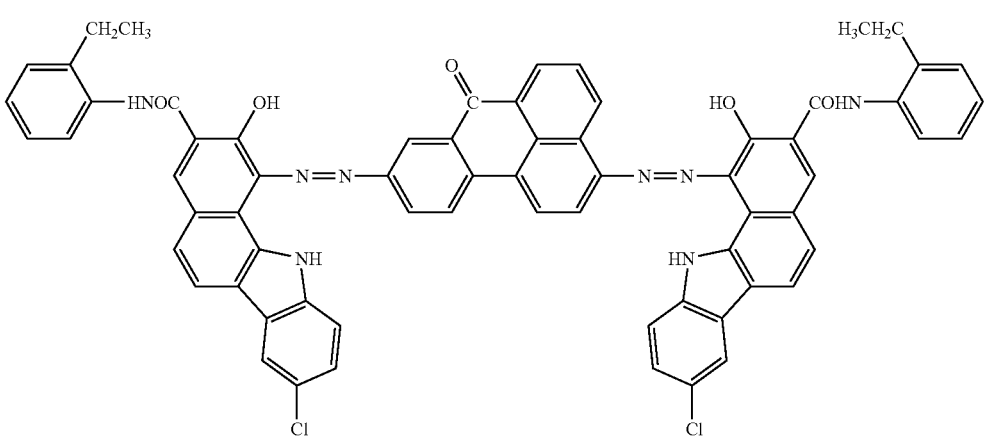

(9)

Evaluation was made in the same way. The results are shown in Table 1.

Example 13

An electrophotographic photosensitive member was produced in the same manner as in Example 1 except that, in Example 1, 10 parts of the polyarylate resin having the repeating structural unit represented by the above formula (8), used in the hole transport layer, was changed for 10 parts of a bisphenol-Z type polycarbonate resin (trade name: IUPILON; available from Mitsubishi Engineering-Plastics Corporation). Evaluation was made in the same way. The results are shown in Table 1.

Example 14

An electrophotographic photosensitive member was produced in the same manner as in Example 1 except that, in Example 1, 6 parts of the phenanthrene compound having the structure represented by the above formula (2-1), used in the charge generation layer, was changed for 6 parts of a phenanthroline compound having a structure represented by the above formula (3-4), and 10 parts of the polyarylate resin having the repeating structural unit represented by the above formula (8), used in the hole transport layer, was changed for 10 parts of a bisphenol-Z type polycarbonate resin (trade name: IUPILON; available from Mitsubishi Engineering-Plastics Corporation). Evaluation was made in the same way-.The results are shown in Table 1.

Comparative Example 1

An electrophotographic photosensitive member was produced in the same manner as in Example 1 except that, in Example 1, the phenanthrene compound having the structure represented by the above formula (2-1), used in the charge generation layer, was not used. Evaluation was made in the same way. The results are shown in Table 1.

Comparative Example 2

An electrophotographic photosensitive member was produced in the same manner as in Example 1 except that, in Example 1, the phenanthrene compound having the structure represented by the above formula (2-1), used in the charge generation layer, was not used and that 10 parts of the polyarylate resin having the repeating structural unit represented by the above formula (8), used in the hole transport layer, was changed for 10 parts of a bisphenol-Z type polycarbonate resin (trade name: IUPILON; available from Mitsubishi Engineering-Plastics Corporation). Evaluation was made in the same way. The results are shown in Table 1.

TABLE 1

| | Charge generation layer | | | | | | | |
|---|---|---|---|---|---|---|---|---|
| | Charge generating material | | Binder resin | | Eletron transporting material | | | |
| | Type | Amt. (pbw) | Type | Amt. (pbw) | Type | Amt. (pbw) | (1) (wt %) | (2) |
| Example: | | | | | | | | |
| 1 | HOGaPc | 20 | Butyral | 10 | (2-1) | 6 | 60 | 0.020 |
| 2 | HOGaPc | 20 | Butyral | 10 | (2-4) | 6 | 60 | 0.012 |
| 3 | HOGaPc | 20 | Butyral | 10 | (2-6) | 6 | 60 | 0.009 |
| 4 | HOGaPc | 20 | Butyral | 10 | (2-14) | 6 | 60 | 0.016 |
| 5 | HOGaPc | 20 | Butyral | 10 | (3-4) | 6 | 60 | 0.011 |
| 6 | HOGaPc | 20 | Butyral | 10 | (3-15) | 6 | 60 | 0.010 |
| 7 | HOGaPc | 20 | Butyral | 10 | (4-1) | 6 | 60 | 0.030 |
| 8 | HOGaPc | 20 | Butyral | 10 | (4-7) | 6 | 60 | 0.012 |
| 9 | HOGaPc | 20 | Butyral | 10 | (4-15) | 6 | 60 | 0.020 |
| 10 | ClGaPc | 20 | Butyral | 10 | (2-1) | 6 | 60 | 0.032 |
| 11 | TiOPc | 20 | Butyral | 10 | (2-1) | 6 | 60 | 0.035 |
| 12 | (9) | 20 | Butyral | 10 | (2-1) | 6 | 60 | 0.040 |
| 13 | HOGaPc | 20 | Butyral | 10 | (2-1) | 6 | 60 | 0.025 |
| 14 | HOGaPc | 20 | Butyral | 10 | (3-4) | 6 | 60 | 0.020 |
| Comparative Example: | | | | | | | | |
| 1 | HOGaPc | 20 | Butyral | 10 | — | 0 | 0 | 0.055 |
| 2 | HOGaPc | 20 | Butyral | 10 | — | 0 | 0 | 0.055 |

(1): Proportion to binder resin (2): Evaluation on ghost (four-color average value of density difference)

Example 15

An electrophotographic photosensitive member was produced in the same manner as in Example 1 except that, in Example 1, 6 parts of the phenanthrene compound having the structure represented by the above formula (2-1), used in the charge generation layer, was changed for 0.5 part of a phenanthroline compound having a structure represented by the above formula (3-4).

Evaluation was made in the same way as in Example 1 except that, as the evaluation apparatus, an evaluation apparatus was used in which the contact charging means having a charging roller, which was the charging means of the evaluation apparatus used in Example 1, was changed for a corona charging means having a corona charging assembly. The results are shown in Table 2.

Example 16

An electrophotographic photosensitive member was produced in the same manner as in Example 15 except that, in Example 15, the amount 0.5 part of the phenanthroline compound having the structure represented by the above formula (3-4), used in the charge generation layer, was changed to 1.0 part. Evaluation was made in the same way. The results are shown in Table 2.

Example 17

An electrophotographic photosensitive member was produced in the same manner as in Example 15 except that, in Example 15, the amount 0.5 part of the phenanthroline compound having the structure represented by the above formula (3-4), used in the charge generation layer, was changed to 1.5 parts. Evaluation was made in the same way. The results are shown in Table 2.

Example 18

An electrophotographic photosensitive member was produced in the same manner as in Example 15 except that, in Example 15, the amount 0.5 part of the phenanthroline compound having the structure represented by the above formula (3-4), used in the charge generation layer, was changed to 3.5 parts. Evaluation was made in the same way. The results are shown in Table 2.

Example 19

An electrophotographic photosensitive member was produced in the same manner as in Example 15 except that, in Example 15, the amount 0.5 part of the phenanthroline compound having the structure represented by the above formula (3-4), used in the charge generation layer, was changed to 5.1 parts. Evaluation was made in the same way. The results are shown in Table 2.

Example 20

An electrophotographic photosensitive member was produced in the same manner as in Example 15 except that, in Example 15, the amount 0.5 part of the phenanthroline compound having the structure represented by the above formula (3-4), used in the charge generation layer, was changed to 6.0 parts. Evaluation was made in the same way. The results are shown in Table 2.

Example 21

An electrophotographic photosensitive member was produced in the same manner as in Example 15 except that, in Example 15, the amount 0.5 part of the phenanthroline compound having the structure represented by the above formula (3-4), used in the charge generation layer, was changed to 8.0 parts. Evaluation was made in the same way. The results are shown in Table 2.

Example 22

An electrophotographic photosensitive member was produced in the same manner as in Example 15 except that, in Example 15, the amount 0.5 part of the phenanthroline compound having the structure represented by the above formula (3-4), used in the charge generation layer, was changed to 12.0 parts. Evaluation was made in the same way. The results are shown in Table 2.

Example 23

An electrophotographic photosensitive member was produced in the same manner as in Example 15 except that, in Example 15, the amount 0.5 part of the phenanthroline compound having the structure represented by the above formula (3-4), used in the charge generation layer, was changed to 14.0 parts. Evaluation was made in the same way. The results are shown in Table 2.

Comparative Example 3

An electrophotographic photosensitive member was produced in the same manner as in Example 15 except that, in Example 15, the phenanthrene compound was not used in the charge generation layer. Evaluation was made in the same way. The results are shown in Table 2.

Comparative Example 4

An electrophotographic photosensitive member was produced in the same manner as in Example 15 except that, in Example 15, 0.5 part of the phenanthroline compound having the structure represented by the above formula (3-4), used in the charge generation layer, was changed for 0.5 part of a compound having a structure represented by the following formula (10):

(10)

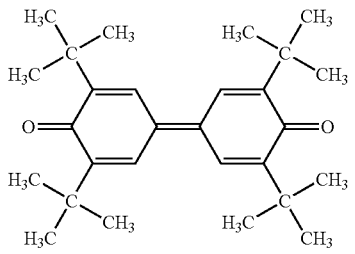

Evaluation was made in the same way. The results are shown in Table 2.

Comparative Example 5

An electrophotographic photosensitive member was produced in the same manner as in Example 17 except that, in Example 17, 1.5 parts of the phenanthroline compound having the structure represented by the above formula (3-4), used in the charge generation layer, was changed for 1.5 parts of a compound having a structure represented by the above formula (10). Evaluation was made in the same way. The results are shown in Table 2.

Comparative Example 6

An electrophotographic photosensitive member was produced in the same manner as in Example 17 except that, in Example 17, 1.5 parts of the phenanthroline compound having the structure represented by the above formula (3-4), used in the charge generation layer, was changed for 1.5 parts of a compound having a structure represented by the following formula (11):

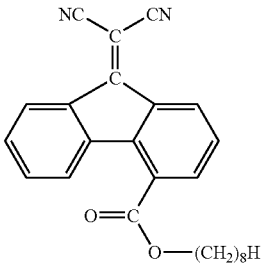

(11)

Evaluation was made in the same way. The results are shown in Table 2.

TABLE 2

| | Charge generation layer | | | | | | | |
|---|---|---|---|---|---|---|---|---|
| | Charge generating material | | Binder resin | | Electron transporting material | | | |
| | Type | Amt. (pbw) | Type | Amt. (pbw) | Type | Amt. (pbw) | (1) (wt %) | (2) |
| Example: | | | | | | | | |
| 15 | HOGaPc | 20 | Butyral | 10 | (3-4) | 0.5 | 5 | 0.035 |
| 16 | HOGaPc | 20 | Butyral | 10 | (3-4) | 1 | 10 | 0.032 |
| 17 | HOGaPc | 20 | Butyral | 10 | (3-4) | 1.5 | 15 | 0.028 |
| 18 | HOGaPc | 20 | Butyral | 10 | (3-4) | 3.5 | 35 | 0.025 |
| 19 | HOGaPc | 20 | Butyral | 10 | (3-4) | 5.1 | 51 | 0.020 |
| 20 | HOGaPc | 20 | Butyral | 10 | (3-4) | 6 | 60 | 0.015 |
| 21 | HOGaPc | 20 | Butyral | 10 | (3-4) | 8 | 80 | 0.020 |
| 22 | HOGaPc | 20 | Butyral | 10 | (3-4) | 12 | 120 | 0.025 |
| 23 | HOGaPc | 20 | Butyral | 10 | (3-4) | 14 | 140 | 0.035 |
| Comparative Example: | | | | | | | | |
| 3 | HOGaPc | 20 | Butyral | 10 | — | — | 0 | 0.065 |
| 4 | HOGaPc | 20 | Butyral | 10 | (10) | 0.5 | 5 | 0.060 |
| 5 | HOGaPc | 20 | Butyral | 10 | (10) | 1.5 | 15 | 0.050 |
| 6 | HOGaPc | 20 | Butyral | 10 | (11) | 1.5 | 15 | 0.050 |

(1): Proportion to binder resin (2): Evaluation on ghost (four-color average value of density difference)

In Tables 1 and 2, "HOGaPc" stands for the hydroxygallium phthalocyanine crystals with a crystal form having strong peaks at Bragg angles 2θ plus-minus 0.2° of 7.3°, 24.9° and 28.1° in CuKα characteristic X-ray diffraction, obtained in Synthesis Example 1. "ClGaPc" stands for the chlorogallium phthalocyanine crystals with a crystal form having strong peaks at Bragg angles 2θ plus-minus 0.2° of 7.4°, 16.6°, 25.5° and 28.2° in CuKα characteristic X-ray diffraction. "TiOPc" stands for the oxytitanium phthalocyanine crystals with a crystal form having strong peaks at Bragg angles 2θ plus-minus 0.2° of 9.0°, 14.2°, 23.9° and 27.1° in CuKα characteristic X-ray diffraction. "Butyral" stands for the polyvinyl butyral resin (trade name: S-LEC BX-1, available from Sekisui Chemical Co., Ltd.).

As having been described above, the present invention can provide the electrophotographic photosensitive member that is excellently effective in keeping ghosts from occurring, and can not easily cause the ghost phenomenon even when mounted to color electrophotographic apparatus or electrophotographic apparatus having no destaticizing means, and provide the process cartridge and the electrophotographic apparatus which have such an electrophotographic photosensitive member.

What is claimed is:

1. An electrophotographic photosensitive member comprising a support, a charge generation layer containing a charge generating material and a binder resin, provided on the support, and a hole transport layer containing a hole transporting material, provided on the charge generation layer, wherein said charge generation layer contains an acenaphthene compound having a structure represented by the following formula (4):

(4)

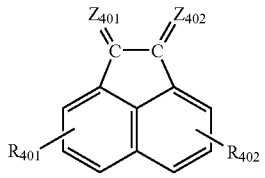

wherein $Z^{401}$ and $Z^{402}$ each independently represent an oxygen atom, a $=C(CN)_2$ group or a $=N$ Ph group; and $R^{401}$ and $R^{402}$ each independently represent a hydrogen atom, a halogen atom, a nitro group, a substituted or unsubstituted alkyl group or a substituted or unsubstituted alkoxy group; and wherein the acenaphthene compound having the structure represented by the above formula (4) is contained in said charge generation layer in an amount of from 51% by weight to 80% by weight based on the weight of the binder resin in said charge generation layer.

2. The electrophotographic photosensitive member according to claim 1, wherein said charge generating material is a gallium phthalocyanine.

3. The electrophotographic photosensitive member according to claim 2, wherein said gallium phthalocyanine is hydroxygallium phthalocyanine.

4. A process cartridge comprising an electrophotographic photosensitive member and at least one means selected from the group consisting of a charging means, a developing means, a transfer means and a cleaning means, which are integrally supported; the process cartridge being detachably mountable to the main body of an electrophotographic apparatus;

said electrophotographic photosensitive member being an electrophotographic photosensitive member comprising a support, a charge generation layer containing a charge generating material and a binder resin, provided on the support, and a hole transport layer containing a hole transporting material, provided on the charge generation layer, wherein said charge generation layer contains an acenaphthene compound having a structure represented by the following formula (4):

(4)

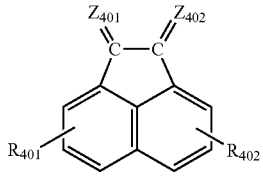

wherein $Z^{401}$ and $Z^{402}$ each independently represent an oxygen atom, a $=C(CN)_2$ group or a $=N$ Ph group; and $R^{401}$ and $R^{402}$ each independently represent a hydrogen atom, a halogen atom, a nitro group, a substituted or unsubstituted alkyl group or a substituted or unsubstituted alkoxy group; and wherein the acenaphthene compound having the structure represented by the above formula (4) is contained in said charge generation layer in an amount of from 51% by weight to 80% by weight based on the weight of the binder resin in said charge generation layer.

5. An electrophotographic apparatus comprising an electrophotographic photosensitive member, a charging means, an exposure means, a developing means and a transport means;

said electrophotographic photosensitive member being an electrophotographic photosensitive member comprising a support, a charge generation layer containing a charge generating material and a binder resin, provided on the support, and a hole transport layer containing a hole transporting material, provided on the charge generation layer, wherein said charge generation layer contains an acenaphthene compound having a structure represented by the following formula (4):

(4)

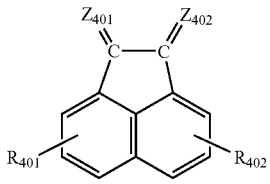

wherein $Z^{401}$ and $Z^{402}$ each independently represent an oxygen atom, a $=C(CN)^2$ group or a $=N$ Ph group; and $R^{401}$ and $R^{402}$ each independently represent a hydrogen atom, a halogen atom, a nitro group, a substituted or unsubstituted alkyl group or a substituted or unsubstituted alkoxy group; and wherein the acenaphthene compound having the structure represented by the above formula (4) is contained in said charge generation layer in an amount of from 51% by weight to 80% by weight based on the weight of the binder resin in said charge generation layer.

* * * * *